US005946822A

United States Patent [19]

Maturaporn

[11] Patent Number: 5,946,822

[45] Date of Patent: Sep. 7, 1999

[54] SHOE BOOTS

[76] Inventor: Thawatchai Maturaporn, 19th Floor,TIT Tower, 861/8 Soi Wat Pai-Ngem, Bangklo, Bang-Korleam, Bangkok, 10120, Thailand

[21] Appl. No.: 09/207,788

[22] Filed: Dec. 9, 1998

[51] Int. Cl.[6] ..... A43B 1/02

[52] U.S. Cl. ..... 36/9 A; 36/7.1 R; 36/9 R

[58] Field of Search ..... 36/7.1 R, 9 R, 36/9 A, 59 R, 1.5, 2 R

[56] References Cited

U.S. PATENT DOCUMENTS

| | | | |
|---|---|---|---|
| 2,714,771 | 8/1955 | Olfene | 36/9 A |
| 3,648,109 | 3/1972 | Tims et al. | 36/9 R |
| 3,798,503 | 3/1974 | Larsh et al. | 36/9 R |
| 4,023,281 | 5/1977 | Terry | 36/9 R |
| 4,616,428 | 10/1986 | Leger | 36/9 R |
| 5,394,624 | 3/1995 | Siepser | 36/9 R |

*Primary Examiner*—M. D. Patterson
*Attorney, Agent, or Firm*—David and Raymond; Raymond Y. Chan

[57] ABSTRACT

Shoe boots each includes a lower waterproof foot piece and an upper sleeve connected on top of the waterproof foot piece. The waterproof foot piece is made by two identical side pieces. Each of the side pieces has an outer paper fabric layer and an inner coating layer which is a layer of PE material coated on an inner side of the outer paper fabric layer, so as to protect all chemical, water, blood, or other liquid to penetrate through the side piece. Moreover, the two identical sidepieces are connected to form the foot piece by ultrasonic welding to ensure waterproof ability.

6 Claims, 4 Drawing Sheets

SHOE BOOTS

BACKGROUND OF THE INVENTION

The present invention relates to disposable shoe boots, and more particularly to a shoe boot which comprises a waterproof foot piece adapted to entirely cover and protect a user's foot from all chemical or blood to penetrate inside therethrough.

In the laboratory, surgery room, and other industrial area, disposable shoe boots are used to cover the users' shoes from direct contact with dirty water, chemical or blood. Conventional shoe boot merely comprises two sidepieces which are made of paper fabric and are sewed along edges thereof to form a boot shape. A top opening is provided for the user to insert his or her foot (with shoe together) into the shoe boot. An elastic band is stitched around the top opening for holding the conventional shoe boot on the user's foot.

In fact, although such conventional shoe boots may successfully prevent the user's shoe from directly contacting the chemical, water or blood, the conventional shoe boots fail to absolutely protect all the chemical or blood to penetrate inside through the shoe boots. In other words, water, chemical and blood may still penetrate into the inside of the shoe boot through the paper fabric and the sewing edges, that would seriously pollute the user's shoe.

SUMMARY OF THE PRESENT INVENTION

The main object of the present invention is to provide a shoe boot which comprises a waterproof foot piece adapted to absolutely protect the user's shoe and to prevent all chemical, water or blood to penetrate through inside.

Another object of the present invention is to provide a shoe boot which utilizes ultrasonic welding to seal all the connection edges in order to ensure 100% waterproof for the waterproof foot piece.

Another object of the present invention is to provide a shoe boot which bottom surface provides non-skid pattern printed thereon to prevent slipping.

Another object of the present invention is to provide a shoe boot which also provides stitching elastic band at sole, that not only enables the user to fit his or her shoe inside the foot piece more easily, but also provides a plurality of wrinkles at sole to further resist slipping.

Another object of the present invention is to provide a shoe boot which provides an additional stitching elastic band at ankle portion for tightening the foot piece of the shoe boot to cover the user's shoe.

Accordingly, in order to accomplish the above objects, the present invention provides a shoe boot which comprises a lower waterproof foot piece and an upper sleeve connected on top of the waterproof foot piece.

The waterproof foot piece comprises two identical sidepieces. Each of the side pieces comprises an outer paper fabric layer and an inner coating layer which is a layer of PE material coated on an inner side of the outer paper fabric layer, so as to protect all chemical, water, blood, or other liquid to penetrate through the side piece.

Each of the side pieces contains a front edge, a rear edge, a top edge extending between two top ends of the front and rear edges, and a bottom edge extending between two bottom ends of the front and rear edges. The front edges, the bottom edges and the rear edges of the two identical side pieces are continuously welded together by ultrasonic welding to form the foot piece, so that an ultrasonic welding stripe is extended along the front edges, the bottom edges and the rear edges of the two identical side pieces to sealedly define a receiving chamber between the two side pieces for receiving a user's foot and shoe. The two top edges of the two side pieces combine to form a top end of the foot piece and to define a circular top opening for the receiving chamber. An ankle elastic band is provided around the top end of the foot piece, i.e. sewing along the two top ends of the two sidepieces, so as to hold the top end of foot piece on an ankle portion of the user's foot.

A bottom end of the upper sleeve and the two top edges of the two sidepieces are circularly connected together. A top elastic band is circularly stitched to a top end of the upper sleeve for holding the upper sleeve in position above the user's ankle. A cover tape, which is extended along a circular connecting edge of the bottom end of the upper sleeve and the two top edges of the two side pieces of the foot piece, has two ends respectively welded to the upper sleeve and the foot piece by ultrasonic welding, so as to cover the connecting edge as well as the ankle elastic band, and thus to protect all chemical, water or blood from penetrating through the connecting edge.

A sole elastic band is further stitched along the bottom edges of the two side pieces of the foot piece so as to provide wiles distributing on a bottom side of the foot piece to avoid slipping.

DETAILED DESCRIPTION OF THE PREFERRED EMBODIMENT

Referring to FIGS. 1 to 4, a shoe boot 10 according to a preferred embodiment of the present invention is illustrated, which comprises a lower waterproof foot piece 20 and an upper sleeve 30 connected on top of the waterproof foot piece 20.

Figure 4:
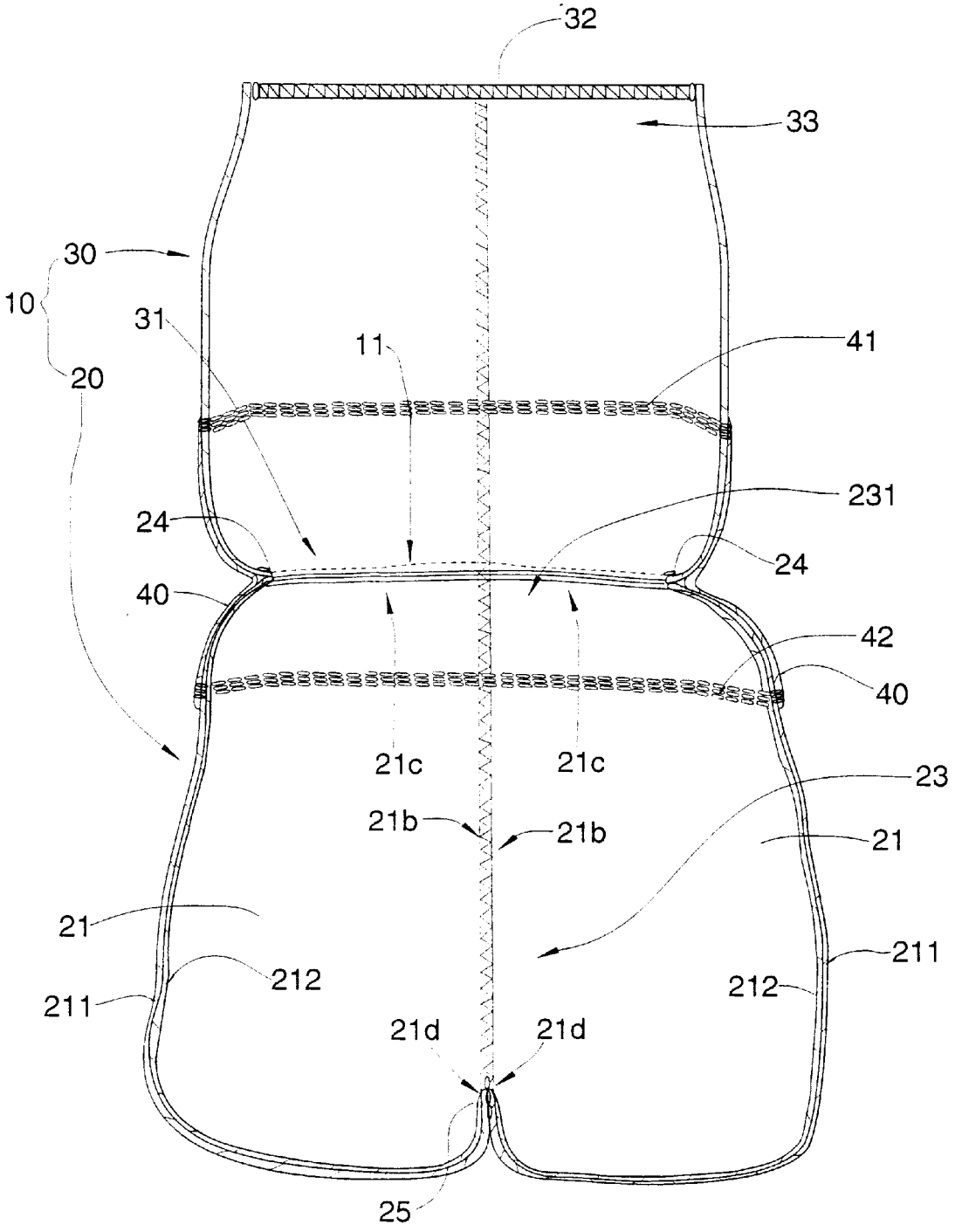
FIG. 4 is a sectional view of the shoe boot according to the above preferred embodiment of the present invention.

The waterproof foot piece 20 comprises two identical side pieces 21. As shown in FIG. 4, each of the side pieces 21 comprises an outer paper fabric layer 211 and an inner coating layer 212 which is a layer of PE material coated on an inner side of the outer paper fabric layer 211, so as to protect all chemical, water, blood, or other liquid to penetrate through the side piece 21.

Figure 2:
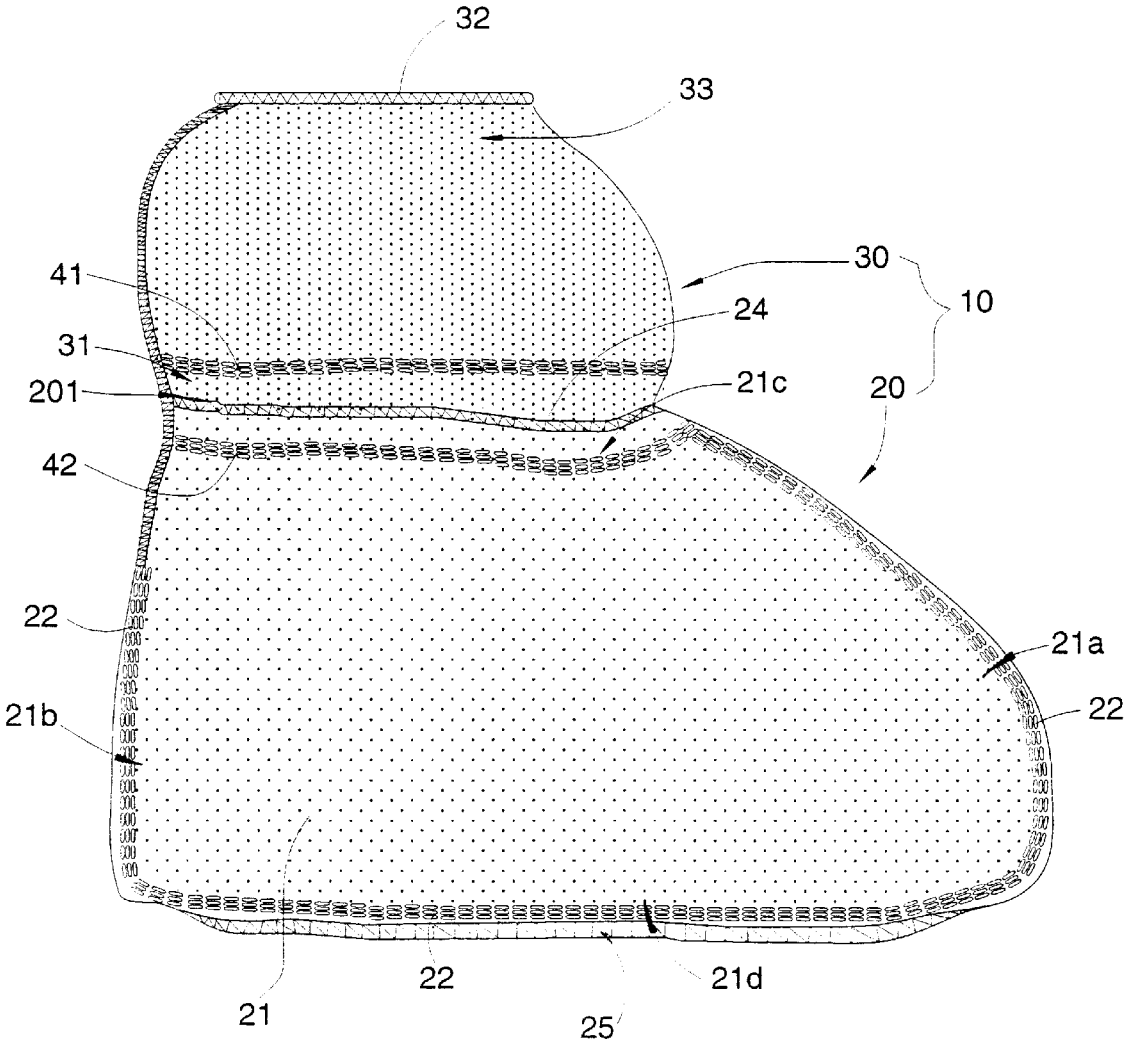
FIG. 2 is a side view of the shoe boot, which is folded inside out, according to the above preferred embodiment of the present invention.
Figure 3:
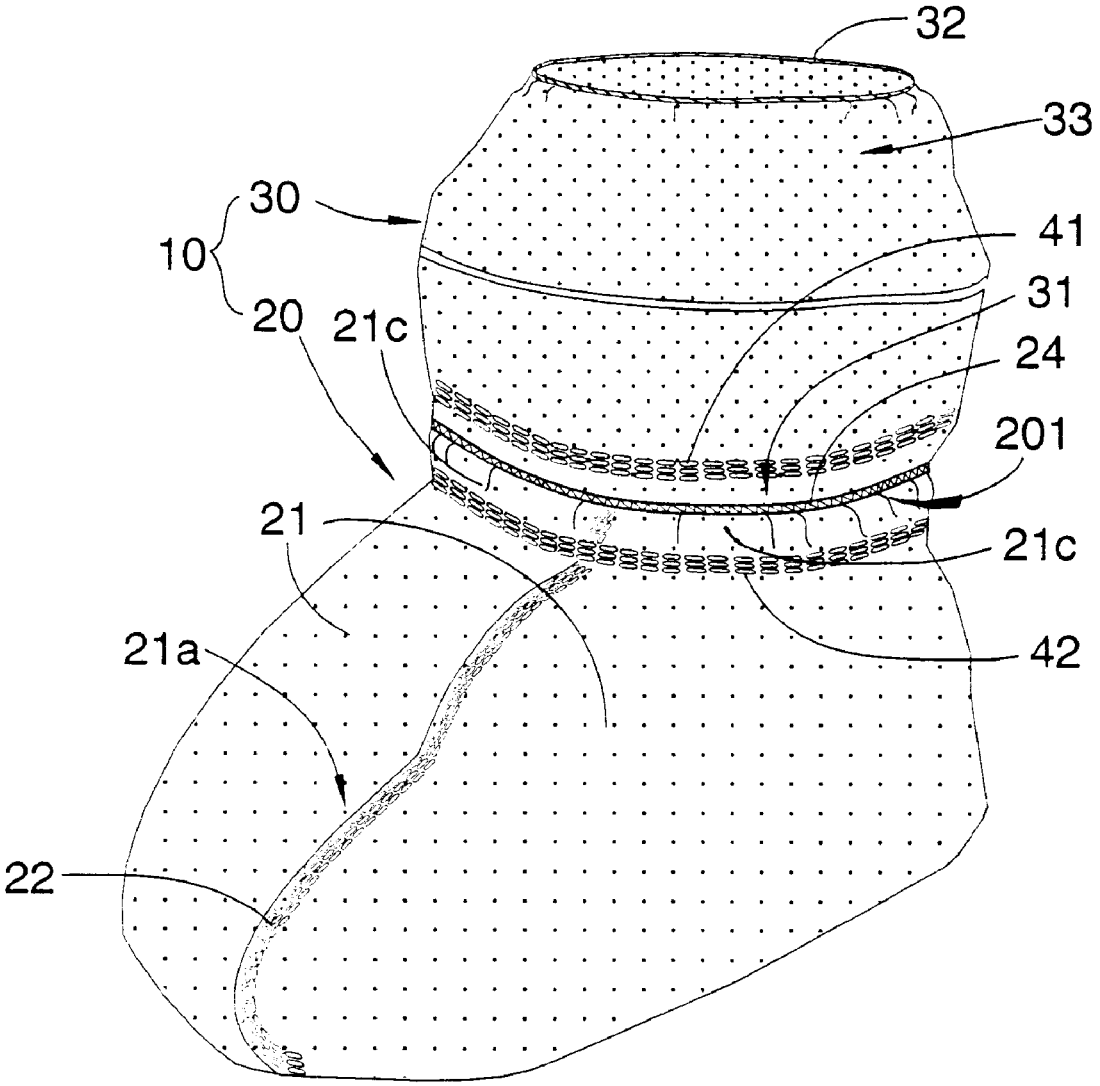
FIG. 3 is a perspective view of the shoe boot, folded inside out, according to the above preferred embodiment of the present invention.

As shown in FIG. 3, each of the side pieces 21 contains a front edge 21*a*, a rear edge 21*b*, a top edge 21*c* extending between two top ends of the front and rear edges 21*a*, 21*b*, and a bottom edge 21*d* extending between two bottom ends of the front and rear edges 21*a*, 21*b*. The front edges 21*a*, the bottom edges 21*d* and the rear edges 21*b* of the two identical side pieces 21 are continuously welded together by ultrasonic welding to form the waterproof foot piece 20, so that an ultrasonic welding stripe 22 (as shown in FIG. 2) is extended along the front edges 21*a*, the bottom edges 21*d* and the rear edges 21*b* of the two identical side pieces 21 to sealedly define a receiving chamber 23 (as shown in FIG. 4) between the two side pieces 21 for receiving a user's foot and shoe. The two top edges 21*c* of the two side pieces 21 combine to form a top end 201 of the waterproof foot piece 20 and to define a circular top opening 231 for the receiving chamber 23 (as shown in FIG. 4).

As shown in Figs. An ankle elastic band 24 is provided around the top end 201 of the waterproof foot piece 20, i.e. sewing along the two top edges 21*c* of the two side pieces 21, so as to hold the top end 201 of foot piece 20 on an ankle portion of the user's foot.

As shown in FIGS. 2 and 4, a sole elastic band 25 is further stitched along the bottom edges 21*d* of the two side pieces 21 of the waterproof foot piece 20 so as to provide wrinkles distributing on a bottom side of the foot piece 20 to avoid slipping. Furthermore, a bottom surface of the waterproof foot piece 20 further provides with non-skid pattern printed thereon to prevent slipping.

As shown in FIGS. 2 to 4, a bottom end 31 of the upper sleeve 30 and the two top edges 21*c* of the two side pieces 21 are circularly connected together. A top elastic band 32 is circularly stitched to a top end 33 of the upper sleeve 30 for holding the upper sleeve 30 in position above the user's ankle.

Figure 1:
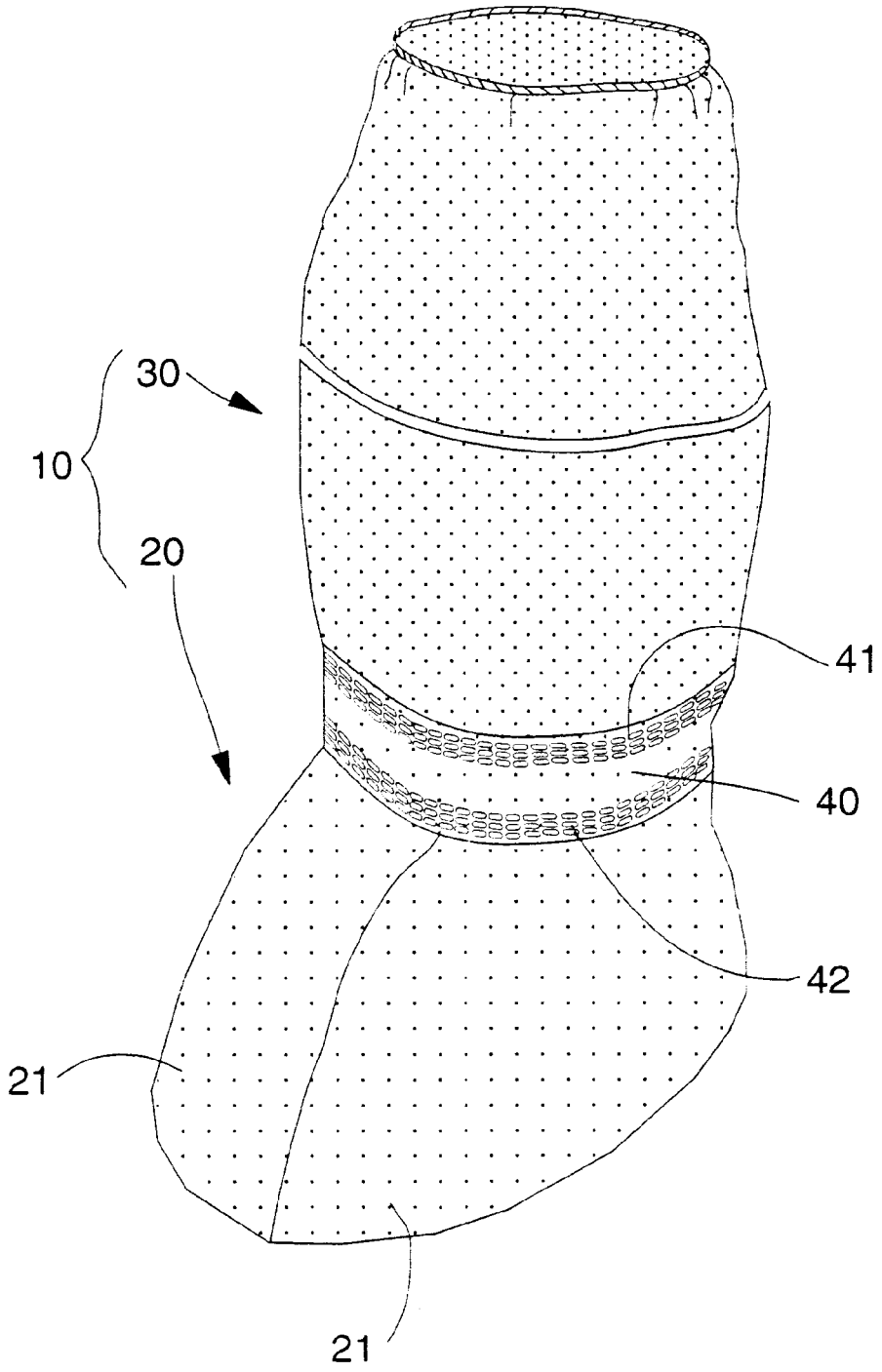
FIG. 1 is a perspective view of a shoe boot according to a preferred embodiment of the present invention.

As shown in FIGS. 1 and 4, a cover tape 40, which is extended along a circular connecting edge 11 of the bottom end 31 of the upper sleeve 30 and the two top edges 21*c* of the two side pieces 21 of the waterproof foot piece 20, has two ends respectively welded to the upper sleeve 30 and the waterproof foot piece 20 by ultrasonic welding to form an upper and a lower ultrasonic welding stripe 41, 42, so as to cover the connecting edge 11 as well as the ankle elastic band 24, and thus to protect all chemical, water or blood from penetrating through the connecting edge 11, as shown in FIG. 4.

As shown in FIG. 1, the upper sleeve 30 is embodied to have a longer length adapted to cover the shin portion below the knee of the user. As shown in FIGS. 2 to 4, the upper sleeve 30 is embodied to have a shorter length to merely cover the ankle portion of the user.

In view of the above disclosure, the user's shoe can be entirely covered and protected by the foot piece 20 of the shoe boot 10 of the present invention, wherein the double-layer structure and the ultrasonic welding applied in the foot piece 20 render the foot piece 20 to absolutely protect the user's shoe and to prevent all chemical, water or blood to penetrate through inside. Moreover, the ultrasonic welding utilized to seal all the connection edges ensures 100% waterproof for the foot piece 20.

Besides, the sole elastic band 25 provided at the bottom of the shoe boot 10 not only enables the user to fit his or her shoe inside the foot piece 20 more easily, but also provides a plurality of wrinkles at sole to further resist slipping while walking. Also, the additional stitching elastic band 24 at ankle portion can tighten the foot piece 20 of the shoe boot 10 to cover the user's shoe.

What is claimed is:

1. A shoe boot, comprising:

a waterproof foot piece comprising two identical side pieces, each of said side pieces comprising an outer paper fabric layer and an inner coating layer which is a layer of PE material coated on an inner side of said outer paper fabric layer, each of said side pieces having a front edge, a rear edge, a top edge extending between two top ends of said front and rear edges, and a bottom edge extending between two bottom ends of said front and rear edges, wherein said front edges, said bottom edges and said rear edges of said two identical side pieces are continuously welded together by ultrasonic welding to form said foot piece, and thus an ultrasonic welding stripe is extended along said front edges, said bottom edges and said rear edges of said two identical side pieces to sealedly define a receiving chamber between said two side pieces, said two top edges of said two side pieces combining to form a top end of said foot piece and to define a circular top opening for said receiving chamber;

an ankle elastic band provided around said top end of said foot piece by sewing along said two top ends of said two side pieces;

a sole elastic band stitched along said bottom edges of said two side pieces of said waterproof foot piece so as to provide wrinkles distributing on a bottom side of said foot piece to avoid slipping; and an upper sleeve connected on top of said waterproof foot piece.

2. A shoe boot, as recited in claim 1, wherein a bottom end of said upper sleeve and said two top edges of said two side pieces are circularly connected together to form a circular connecting edge.

3. A shoe boot, as recited in claim 1, wherein a top elastic band is circularly stitched to a top end of said upper sleeve.

4. A shoe boot, as recited in claim 2, wherein a top elastic band is circularly stitched to a top end of said upper sleeve.

5. A shoe boot, as recited in claim 2, further comprising a cover tape extended along said circular connecting edge of said bottom end of said upper sleeve and said two top edges of said two side pieces of said foot piece, wherein said cover tape has two ends respectively welded to said upper sleeve and said foot piece by ultrasonic welding, so as to cover said connecting edge as well as said ankle elastic band.

6. A shoe boot, as recited in claim 4, further comprising a cover tape extended along said circular connecting edge of said bottom end of said upper sleeve and said two top edges of said two side pieces of said foot piece, wherein said cover tape has two ends respectively welded to said upper sleeve and said foot piece by ultrasonic welding, so as to cover said connecting edge as well as said ankle elastic band.

* * * * *